US011725812B2

(12) United States Patent
Yoon

(10) Patent No.: US 11,725,812 B2
(45) **Date of Patent: *Aug. 15, 2023**

(54) COOKING DEVICE

(71) Applicant: LG ELECTRONICS INC., Seoul (KR)

(72) Inventor: Youngkook Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 230 days.

This patent is subject to a terminal disclaimer.

(21) Appl. No.: 17/191,597

(22) Filed: Mar. 3, 2021

(65) Prior Publication Data

US 2021/0190312 A1 Jun. 24, 2021

Related U.S. Application Data

(62) Division of application No. 16/250,833, filed on Jan. 17, 2019, now Pat. No. 10,982,845, which is a division of application No. 15/000,576, filed on Jan. 19, 2016, now Pat. No. 10,222,058.

(30) Foreign Application Priority Data

Jan. 16, 2015 (KR) ..... 10-2015-0007751

(51) Int. Cl.

| | |
|---|---|
| ***F23D 14/10*** | (2006.01) |
| ***F24C 3/10*** | (2006.01) |
| *F24C 15/32* | (2006.01) |

(52) U.S. Cl.
CPC ..... *F23D 14/10* (2013.01); *F24C 3/103* (2013.01); *F23D 2207/00* (2013.01); *F24C 15/322* (2013.01)

(58) Field of Classification Search
CPC ..... F23D 14/10; F23D 2207/00; F24C 3/103; F24C 15/322
See application file for complete search history.

(56) References Cited

U.S. PATENT DOCUMENTS

| | | | | |
|---|---|---|---|---|
| 3,338,231 | A | 8/1967 | Lamar | |
| 3,719,180 | A | 3/1973 | Pere | |
| 10,222,058 | B2 * | 3/2019 | Yoon | F23D 14/10 |
| 10,982,845 | B2 * | 4/2021 | Yoon | F24C 3/103 |
| 2014/0144422 | A1 | 5/2014 | Wie | |

FOREIGN PATENT DOCUMENTS

| | | |
|---|---|---|
| JP | 3178043 | 8/2012 |
| JP | 3178043 U | 8/2012 |
| KR | 20140067749 A | 6/2014 |

* cited by examiner

*Primary Examiner* — Alfred Basichas
(74) *Attorney, Agent, or Firm* — Bryan Cave Leighton Paisner LLP

(57) ABSTRACT

A cooking device is provided. The cooking device includes a frame that forms a cooking chamber; a burner provided inside the frame and having a plurality of gas outlet holes; an ignition unit provided inside the frame to ignite a mixed gas discharged from at least one of the plurality of gas outlet holes; and a fixing device to affix a position of the ignition unit with respect to the burner.

17 Claims, 16 Drawing Sheets

COOKING DEVICE

CROSS-REFERENCE TO RELATED APPLICATION

This application is a Divisional of U.S. patent application Ser. No. 16/250,833, filed Jan. 17, 2019, now allowed, which is a Divisional of U.S. patent application Ser. No. 15/000,576, filed Jan. 19, 2016, now U.S. Pat. No. 10,222,058, which claims priority under 35 U.S.C. § 119 and 35 U.S.C. § 365 to Korean Patent Application No. 10-2015-0007751, filed in Korea on Jan. 16, 2015, which is hereby incorporated by reference.

BACKGROUND

1. Field

The present disclosure relates to a cooking device.

2. Background

A cooking device is a device for cooking food using heat from a heat source. For example, a cooking device generally includes an oven range having an oven chamber in which the food is cooked, and a burner provided in the oven chamber to burn gas.

An example of a conventional oven range is provided in Korean Patent Publication No. 2010-0013997 (published on Feb. 10, 2010). Korean Patent Publication No. 2010-0013997 describes an oven range having a burner chamber provided below a bottom surface thereof, which forms an oven chamber, and a lower burner installed at the burner chamber to convectively heat food in the oven chamber. However, such arrangement is perceived to have some disadvantages.

For example, to provide air heated by the lower burner from the burner chamber to the oven chamber, the oven chamber and the burner chamber must be in communication with each other. However, because the burner chamber is provided below the oven chamber, a part of the bottom surface of the oven chamber should be opened. However, when a part of the bottom surface of the oven chamber is opened, food leftovers or the like may be introduced into the burner chamber through an opened portion of the oven chamber and the burner chamber, while the food is cooked in the oven chamber or the food is put into or taken out of the oven chamber.

Also, because a part of the bottom surface of the oven chamber is opened, it is not easy to clean the oven chamber due to an opening of the bottom surface.

Also, because the lower burner is installed below the oven chamber, a cavity capacity of the oven chamber is reduced.

Moreover, in arrangements having the lower burner installed outside of the oven chamber, when it is necessary to replace or check an ignition unit for igniting a mixed gas supplied to the lower burner, the oven chamber includes an outer case that needs to be separated, which is complicated and time consuming.

SUMMARY

The present disclosure is directed to an improved cooking device having a cooking chamber that is easier to clean and has an increased capacity compared to a conventional cooking device.

Moreover, the present disclosure is directed to an improved cooking device having an ignition unit for igniting a mixed gas that is easier to access compared to the ignition unit of a conventional cooking device.

According to an embodiment of the invention, there is provided a cooking device including a frame that forms a cooking chamber; a burner provided in the frame and having a plurality of gas outlet holes; an ignition unit provided in the frame to ignite a mixed gas discharged from at least one of the plurality of gas outlet holes; and a fixing device to affix a position of the ignition unit with respect to the burner.

According to another embodiment of the invention, there is provided a cooking device including a frame that forms a cooking chamber; a burner cover provided in the frame to form a combustion chamber that is partitioned from the cooking chamber; a burner provided at the combustion chamber and having a plurality of gas outlet holes; an ignition unit provided at the combustion chamber to ignite a mixed gas discharged from at least one of the plurality of gas outlet holes; and a fixing device to support the ignition unit.

It is to be understood that both the foregoing general description and the following detailed description of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
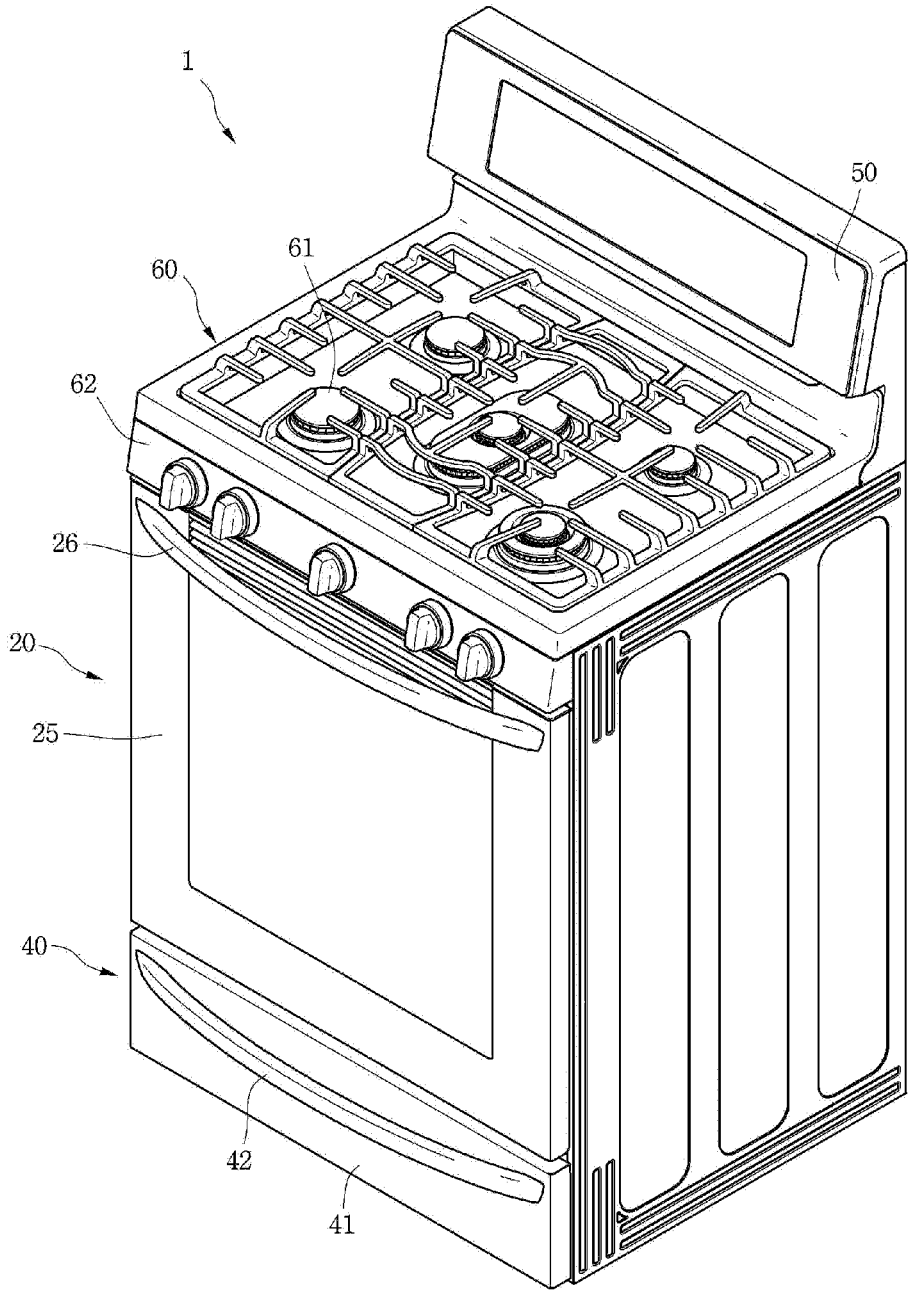
FIG. 1 is a perspective view of a cooking device according to an embodiment of the present disclosure.
Figure 2:
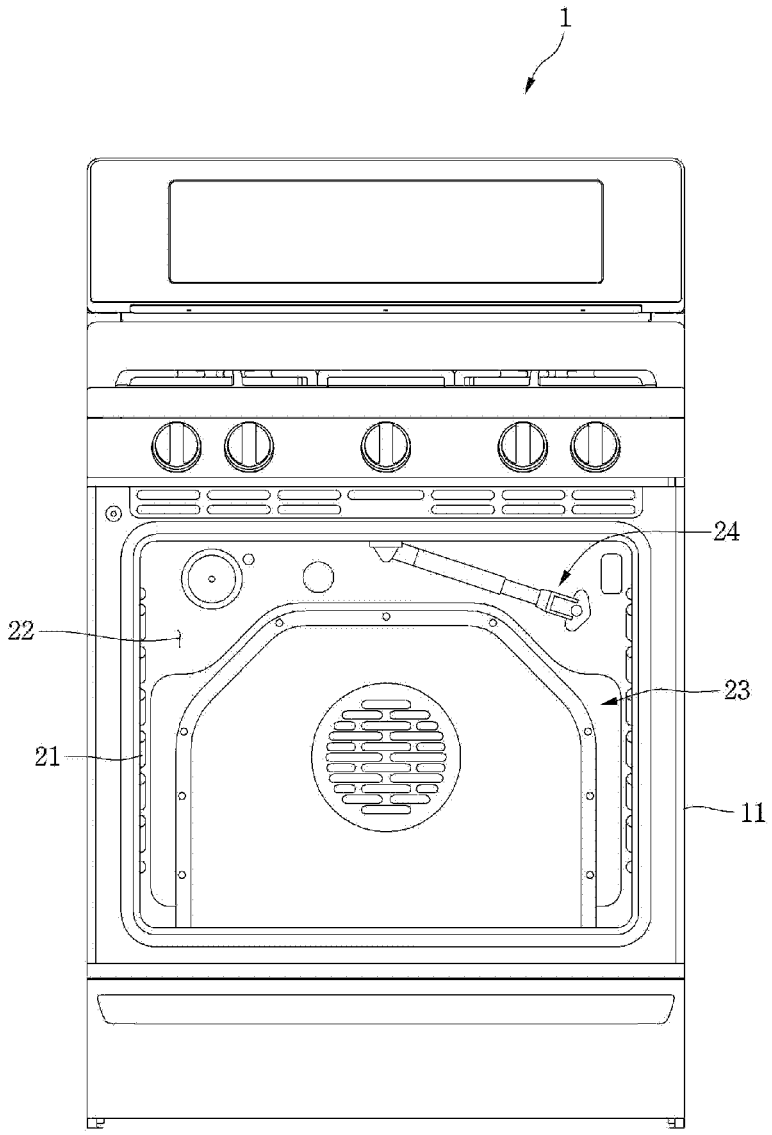
FIG. 2 is a front view illustrating a state in which a door is removed from the cooking device according to an embodiment of the present disclosure.

FIG. 1 is a perspective view of a cooking device according to an embodiment of the present disclosure, and FIG. 2 is a front view illustrating a state in which a door is removed from the cooking device according to an embodiment of the present disclosure.

Referring to FIGS. 1 and 2, a cooking device 1 may include an oven unit 20. Cooking device 1 may further include a cook-top unit 60. Cooking device 1 may further include a drawer unit 40. Cooking device 1 may further include a control unit 50. Cooking device 1 may further include an outer case 11, which may cover some of or all of both side surfaces and rear surfaces of the oven unit 20 and the drawer unit 40.

It is understood that cook-top unit 60 and drawer unit 40 may be omitted depending on a type of cooking device 1.

Cook-top unit 60, oven unit 20, and drawer unit 40 may be provided at an upper portion, a center portion and a lower portion of the cooking device 1, respectively. Control unit 50 may be provided at a rear portion of an upper surface of cooking device 1.

Cook-top unit 60 may include a plurality of cook-top burners 61. Cook-top burners 61 may heat a container in which food is put or may directly heat the food using a flame generated by burning a gas, and thus may cook or heat the food. An operational unit 62 to operate the plurality of cook-top burners 61 may be provided at a front end of cook-top unit 60. Alternatively, operational unit 62 may be provided at an upper surface of cook-top unit 60.

It is understood that the invention is not limited to any particular type of heating source to form cook-top unit. For example, cook-top unit 60 may include one or more electric heaters. However, the one or more electric heaters may not project outside of the cook-top unit 60.

Oven unit 20 may include a frame 21 that forms a cooking chamber 22 in which the cooking of the food is performed.

For example, frame 21 may be formed in a rectangular parallelepiped shape of which a front surface is opened, but is not limited such particular shape.

Oven unit 20 may include a burner assembly 23 for cooking the food accommodated in cooking chamber 22. Oven unit 20 may further include an upper burner 24.

The burner assembly 23 and the upper burner 24 may be simultaneously operated, or may be operated one at a time.

Upper burner 24 provides heat to the food from above the food in frame 21, and burner assembly 23 may be provided at a rear of the food in frame 21. For example, upper burner 24 may be installed at an upper wall of frame 21, and burner assembly 23 may be installed at a rear wall of frame 21.

Oven unit 20 may further include a door 25 to open and close (e.g., access) cooking chamber 22. Door 25 may be rotatably connected or hinged to cooking device 1. For example, door 25 may open and close the cooking chamber 22 in a pull-down method whereby an upper end of door 25 is rotated up and down about a lower end of door 25. It is thus understood that the disclosed embodiments are not limited to a particular operating method to open and close door 25.

A door handle 26 which is gripped or manipulated by a user's hand to rotate door 25 may be provided at an upper end of a front surface of door 25.

Drawer unit 40 may also function to maintain the container, in which the food is put, at a predetermined temperature. A drawer 41 in which the container is accommodated may be provided at drawer unit 40. Drawer 41 may be inserted into or withdrawn from cooking device 1 in a sliding method. A handle 42 which is gripped or manipulated by the user may also be provided at a front surface of drawer 41.

Control unit 50 may receive an operation signal to operate cooking device 1, specifically, an operation signal to operate at least one of cook-top unit 60, oven unit 20, and drawer unit 40. Also, control unit 50 may display a variety of information about the operation of the cooking device 1.

Figure 3:
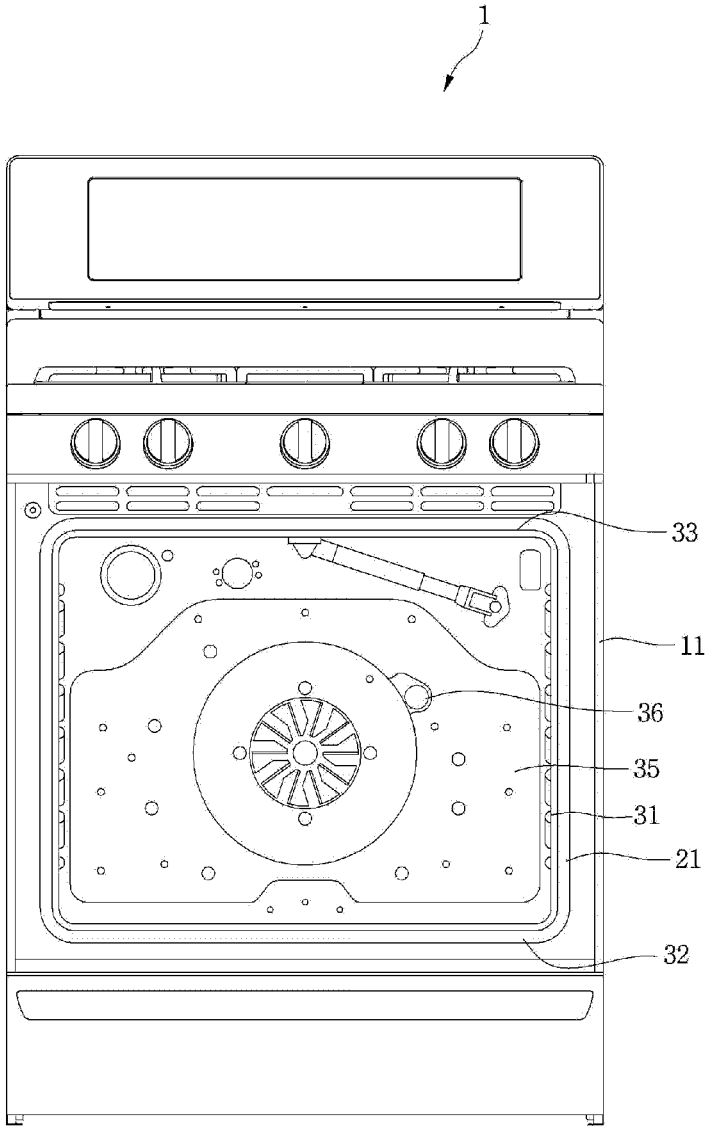
FIG. 3 is a view illustrating a state in which a burner assembly removed from the cooking device illustrated in FIG. 2.
Figure 4:
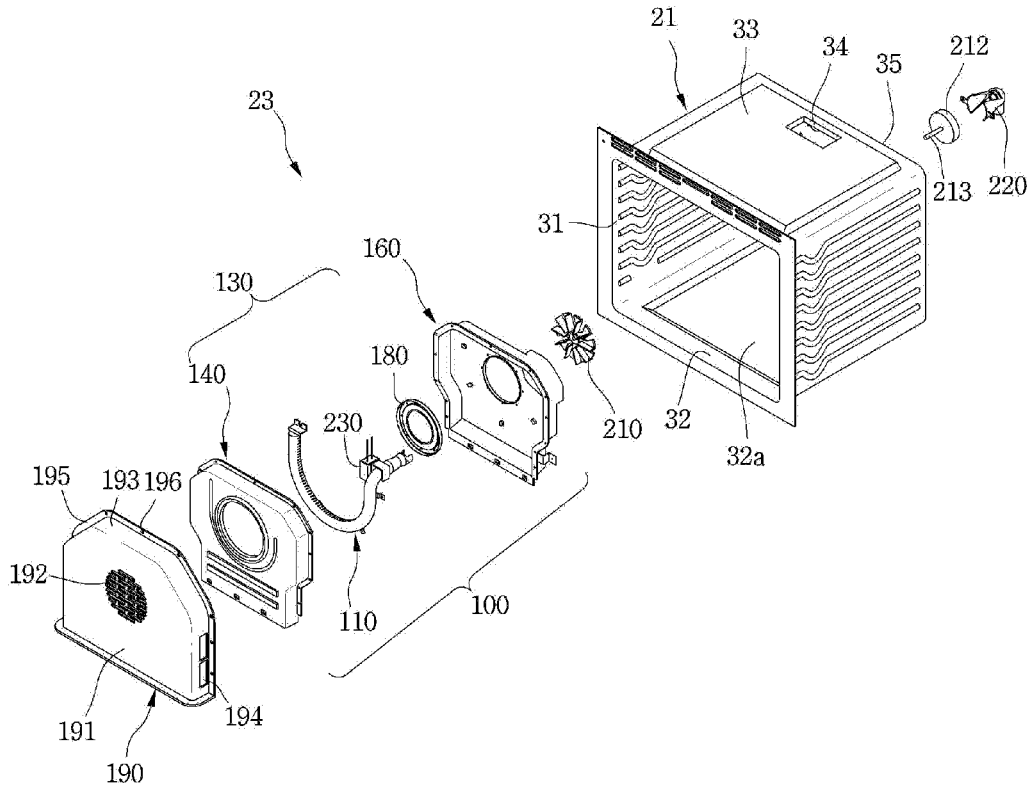
FIG. 4 is an exploded perspective view of the burner assembly according to one embodiment of the present disclosure.

FIG. 3 is a view illustrating a state in which the burner assembly is removed from FIG. 2, and FIG. 4 is an exploded perspective view of the burner assembly according to an embodiment of the present disclosure.

Referring to FIGS. 2, 3, and 4, frame 21 may include both side walls 31, a bottom wall 32, an upper wall 33 and a rear wall 35. However, the frame is not limited to such structure.

In the disclosed embodiments, regarding cooking device 1, a "front" is generally understood to be a direction toward a front surface of cooking device 1, and a "rear" is generally understood to be a direction toward a rear surface of cooking device 1. Regarding cooking chamber 22, a "front" is generally understood to be a direction toward door 25 of oven unit 20, and a "rear" is generally understood to be a direction toward rear wall 35 of frame 21.

Burner assembly 23 may be coupled to rear wall 35 of frame 21. Thus, because burner assembly 23 is not located below frame 21, but is installed at rear wall 35 of frame 21, a recessed portion **32*a* which is recessed downward may be formed at bottom wall 32 of frame 21. Such configuration increases a capacity of frame 21**.

The above-described embodiment provides an example of burner assembly 23 installed at rear wall 35 of frame 21. However, it is understood that burner assembly 23 may alternatively be installed at one of both side walls 31 of frame 21.

Burner assembly 23 may include a burner device 100. Burner device 100 may include a burner 110 to generate a flame by burning a gas, and a burner cover 130 to cover burner 110. Burner assembly 23 may further include an assembly cover 190 to cover burner device 100. Burner assembly 23 may include a fan 210 and a fan motor 212. It is understood that the phrase "located in the frame"—or the like—means "located in a space formed by the frame"—or the like.

A burner hole 36 through which burner 110 passes may be formed at rear wall 35 of frame 21. That is, burner 110 may be located in frame 21, and a part thereof may pass through burner hole 36, and may be located between rear wall 35 of frame 21 and outer case 11.

An exhaust hole 34 through which an exhaust gas is discharged may be formed at upper wall 33 of frame 21. Alternatively, exhaust hole 34 may be formed at rear wall 35 or one of both side walls 31 of frame 21.

Burner cover 130 may include a first cover 140 and a second cover 160. For example, at least a part of first cover 140 may cover burner 110 at a front side of burner 110, and at least a part of second cover 160 may cover burner 110 at a rear side of burner 110.

Burner device 100 may further include an ignition unit 230 to ignite the mixed gas supplied to burner 110. Burner device 100 may further include a stabilizer 180 to stabilize the flame generated from burner 110. Ignition unit 230 may be installed or provided in frame 21, e.g., at burner 110. A portion of ignition unit 230 may be located in burner cover 130 when ignition unit 230 is installed at burner 110.

Burner device 100 will be described below with reference to the accompanying drawings.

Fan motor 212 may be disposed or provided between rear wall 35 of frame 21 and outer case 11. Fan 210 may be located inside frame 21. Therefore, a shaft 213 of fan motor 212 may pass through rear wall 35 of frame 21 and may be coupled to fan 210. Fan motor 212 may be attached to rear wall 35 of frame 21 or outer case 11 by a motor mount, which is not illustrated.

Assembly cover 190 may protect burner device 100. Moreover, assembly cover 190 may prevent food from accumulating in burner device 100 during a cooking operation. Assembly cover 190 may include a front plate 191, an extension part 193 which extends from front plate 191 toward rear wall 35 of frame 21, and a contact part 195 which is bent from extension part 193.

An air suction port 192 through which the air in the cooking chamber 22 is suctioned may be formed at front plate 191, and an air discharge port 194 through which the air heated by burner device 100 is discharged to the cooking chamber 22 may be formed or provided at the extension part 193. Alternatively, air discharge port 194 may be formed or provided at front plate 191, or may be formed or provided at each of front plate 191 and extension part 193.

Contact part 195 may be in contact with rear wall 35 of frame 21, while covering burner device 100. A fastening hole 196 to which a fastening member is attached, which is not shown, may be provided at contact part 195.

When assembly cover 190 is fastened to rear wall 35 of frame 21 by fastening member, a lower end of assembly cover 190 may be in contact with bottom wall 32 of frame 21. That is, lower ends of front plate 191, extension part 19, and contact part 195 may be in contact with bottom wall 32 of frame 21. Alternatively, front plate 191 and extension part 193 may be in contact with bottom wall 32 of frame 21.

At this time, assembly cover 190 may be in contact with bottom wall 32 of frame 21 between recessed portion 32*a* of bottom wall 32 and rear wall 35 of frame 21. Burner assembly 23 may further include a nozzle holder 220 to inject the gas to burner 110. Nozzle holder 220 may be located between rear wall 35 of frame 21 and outer case 11, and may be attached to, for example, rear wall 35 of frame 21. As another example, when an insulating material is installed at an outside of frame 21, nozzle holder 220 may be installed at the insulating material. Nozzle holder 220 may be aligned with burner 110 passed through rear wall 35 of frame 21 and may inject the gas to burner 110.

Figure 5:
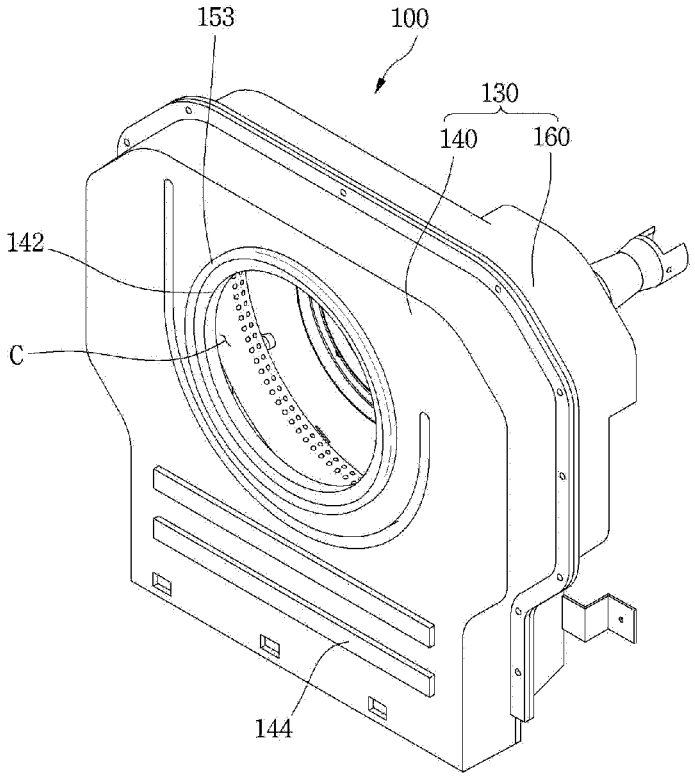
FIG. 5 is a perspective view of a burner device according to an embodiment of the present disclosure.
Figure 6:
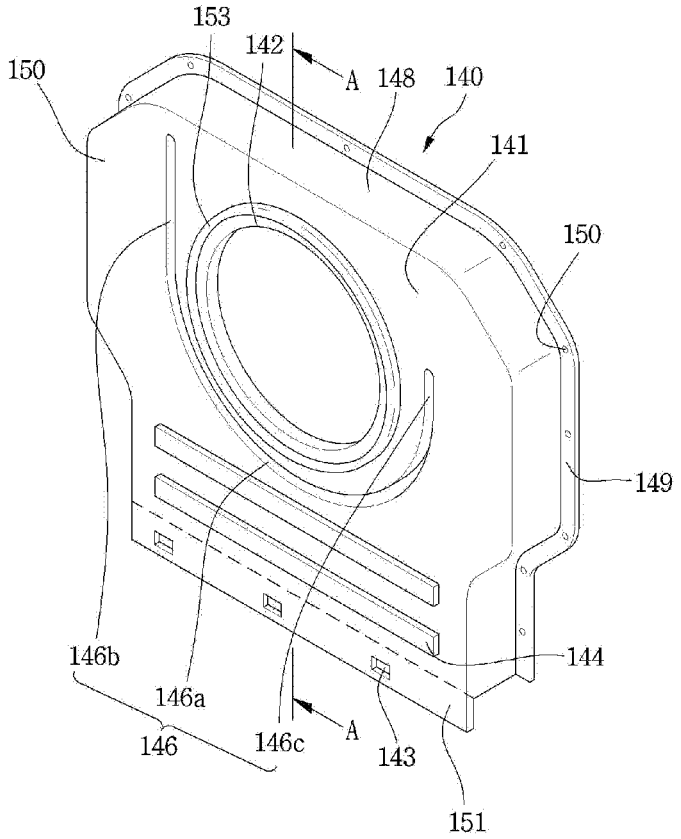
FIG. 6 is a perspective view of a first cover of the burner device of FIG. 5.
Figure 7:
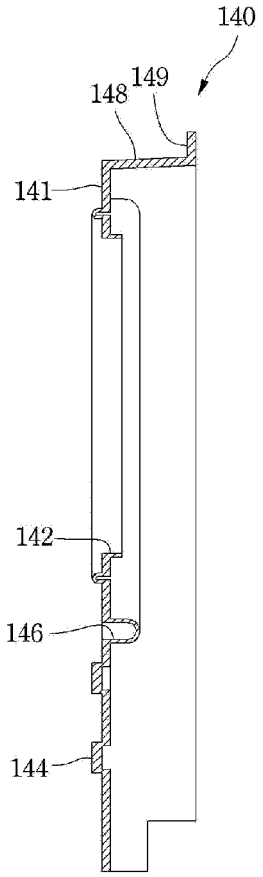
FIG. 7 is a cross-sectional view taken along line A-A of FIG. 6.

FIG. 5 is a perspective view of the burner device according to an embodiment of the present disclosure, FIG. 6 is a perspective view of a first cover of the burner device of FIG. 5, and FIG. 7 is a cross-sectional view taken along line A-A of FIG. 6.

Referring to FIGS. 5, 6, and 7, burner cover 130 may form a combustion chamber C in which the gas is burned. The burner 110 may be located at combustion chamber C.

As described above, burner cover 130 may include first cover 140 and second cover 160. The first cover 140 may include a first plate 141. The first cover 140 may further include a first extension part 148 which extends from first plate 141 toward a rear side thereof, and a first fastening part 149 which is bent from first extension part 148. The first plate 141 may include a first opening 142 through which the air in cooking chamber 22 suctioned through air suction port 192 of assembly cover 190 passes.

The air suction port 192 of assembly cover 190 may be formed having a grille-like shape. The air suction port 192 may be formed by a plurality of holes. The entire shape of the air suction port 192 formed by the plurality of holes may be a circle shape.

To allow the air passed through air suction port 192 to smoothly pass through the first opening 142 of the first cover 140, a diameter of first opening 142 may be the same as or larger than a diameter of the shape of air suction port 192.

The first plate 141 may further include one or more first reinforcing parts 144 located below the first opening 142 to strengthen the first plate 141. The one or more first reinforcing parts 144 may be transversely formed.

FIG. 6 illustrates an example in which a plurality of first reinforcing parts 144 are arranged to be vertically spaced apart from each other. It is understood that the present disclosure is not limited to a particular number and an arrangement of the first reinforcing parts 144. For example, the one or more first reinforcing parts 144 may extend vertically. Alternatively, the one or more first reinforcing parts 144 may be arranged to be horizontally spaced apart from each other.

The first reinforcing parts 144 may protrude from first plate 141 toward a front side thereof. That is, a portion of first plate 141 may be formed so that the first reinforcing parts 144 protrude from first plate 141 toward door 25.

When burner assembly 23 is installed at rear wall 35 of frame 21, first reinforcing parts 144 may be in contact with assembly cover 190. Alternatively, when burner assembly 23 is installed at rear wall 35 of frame 21, the first reinforcing parts 144 may be spaced apart from assembly cover 190, and may be in contact with assembly cover 190 when an external force is applied to assembly cover 190, or first plate 141 or assembly cover 190 expands due to heat.

Accordingly, thermal deformation of first plate 141 may be minimized by first reinforcing parts 144, and also, even when first plate 141 is deformed, additional deformation of first plate 141 may be prevented because first reinforcing parts 144 are in contact with assembly cover 190.

As another example, a part of the plurality of first reinforcing parts 144 may protrude toward a front of first plate 141, and other part thereof may protrude toward a rear of first plate 141. Alternatively, one or more first reinforcing parts 144 may protrude toward the rear of first plate 141.

The first plate 141 may further include a second reinforcing part 153 which is located around a portion of or the entirety of the first opening 142 to reinforce the strength. For example, first opening 142 may be formed in a circular shape, and second reinforcing part 153 may be formed in a ring-like shape which surrounds first opening 142. However, it is understood that the present disclosure is not limited to a particular shape and number of first opening 142, or a particular shape and number of second reinforcing part 153. The second reinforcing part 153 may protrude toward a front of first plate 141. That is, a portion of the first plate 141 may be formed so that second reinforcing part 153 protrudes from first plate 141 toward door 25.

When burner assembly 23 is installed at rear wall 35 of frame 21, second reinforcing part 153 may be in contact with assembly cover 190. As another example, when burner assembly 23 is installed at rear wall 35 of frame 21, the second reinforcing part 153 may be spaced apart from assembly cover 190, and may be in contact with assembly cover 190 when an external force is applied to the assembly cover 190 or first plate 141 or assembly cover 190 expands due to heat.

The first opening 142 of first plate 141 may be disposed to face air suction port 192 of assembly cover 190. Therefore, since the air passed through air suction port 192 of assembly cover 190 flows to first opening 142 of first plate 141 without a change in a flow direction, air circulation may be smoothly performed inside frame 21.

The first plate 141 may further include a first insertion part 151 having one or more first introduction holes 143 through which the air is provided into combustion chamber C. For example, the one or more first introduction holes 143 may be located below first reinforcing parts 144 at first plate 141.

FIG. 6 illustrates an example in which a plurality of first introduction holes 143 are arranged to be horizontally spaced apart from each other. Again, it is understood that the invention is not limited to a particular number, arrangement, and/or shape of the first introduction holes 143.

The first insertion part 151 may pass through the bottom wall 32 of the frame 21. The one or more first introduction holes 143 may be located outside of frame 21. The air outside the frame 21 may be provided to the combustion chamber C through the one or more first introduction holes 143. The first plate 141 may further include an air guide 146 to guide the air provided to the combustion chamber C toward a flame generated from burner 110 and thus increase a contact time between the air and the flame.

The air guide 146 may protrude from first plate 141 to a rear side thereof. That is, a part of the first plate 141 may be formed so that air guide 146 protrudes from first plate 141 toward rear wall 35 of frame 21. The air guide 146 may include a curved portion 146*a*, and linear portions 146*b* and 146*c* which are located at one end or both ends of the curved portion 146*a*. Alternatively, the air guide 146 may include only the curved portion 146*a*. For example, curved portion 146*a* of air guide 146 may be formed in an arc-like shape. A radius of curved portion 146*a* may be larger than that of second reinforcing part 153. Therefore, at least a part of curved portion 146*a* may be disposed between second reinforcing part 153 and first reinforcing parts 144. The distance from a center of first opening 142 to curved portion 146*a* may be smaller than a radius of an inner circumferential surface of burner 110. Therefore, the air introduced into the combustion chamber C may be guided toward the flame of burner 110 by air guide 146. The air guide 146 may be integrally formed with first plate 141, or may be attached to first plate 141.

A cross section of the air guide 146 may be rounded to smoothly guide a flow of the air.

Meanwhile, one or more first fastening holes 150 to which second cover 160 is attached by the fastening member may be formed at first fastening part 149.

Figure 8:
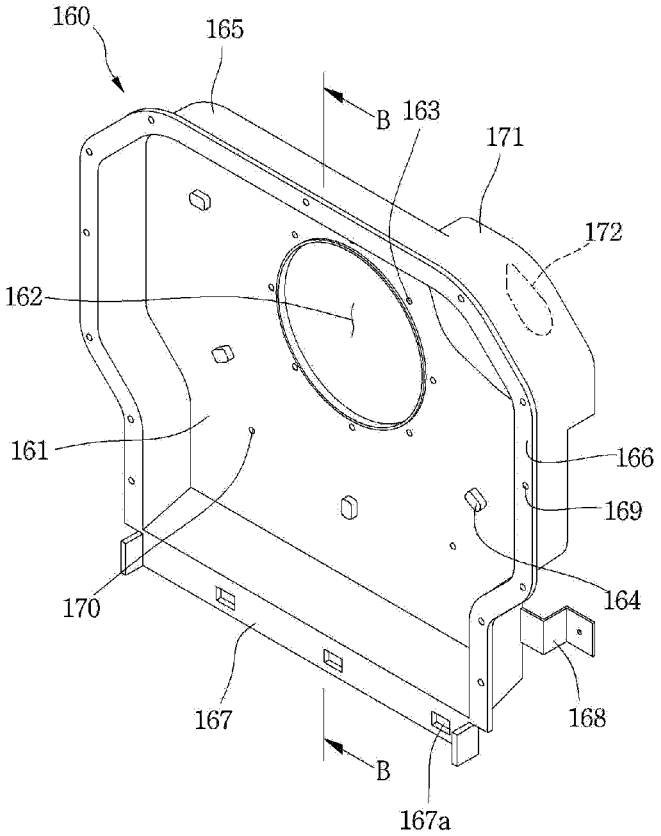
FIG. 8 is a perspective view of a second cover of the burner device of FIG. 5.
Figure 9:
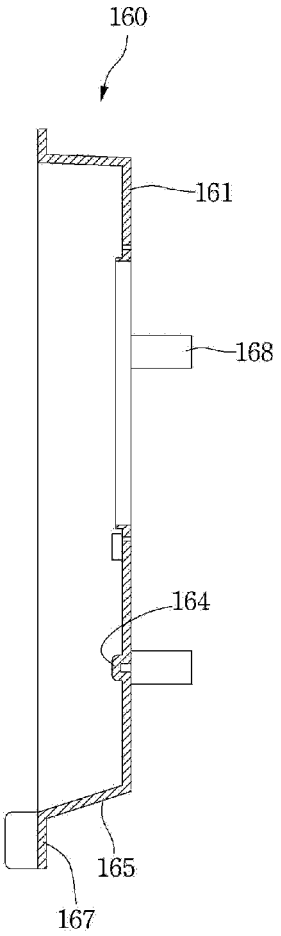
FIG. 9 is a cross-sectional view taken along line B-B of FIG. 8.

FIG. 8 is a perspective view of the second cover of the burner device of FIG. 5, and FIG. 9 is a cross-sectional view taken along line B-B of FIG. 8.

Referring to FIGS. 4, 5, 8 and 9, the second cover 160 may include a second plate 161. The second cover 160 may further include a second extension part 165 which extends from second plate 161 toward a front side thereof, and a second fastening part 166 which is bent from second extension part 165.

The second plate 161 may include a second opening 162 through which the air heated in the combustion chamber C is discharged. The second opening 162 may be formed in a circular shape, but is not limited thereto. A diameter of second opening 162 may be smaller than that of first opening 142.

The second plate 161 may further include a burner fastening hole 170 to which burner 110 is attached. Also, second plate 161 may further include one or more protruding portions 164 which prevent the burner 110 from being directly in contact with second plate 161.

The one or more protruding portions 164 may protrude toward burner 110, when burner 110 is installed at second plate 161. That is, a portion of the second plate 161 may be formed so that the one or more protruding portions 164 protrude toward burner 110.

For example, the one or more protruding portions 164 may be in contact with burner 110. As another example, the one or more protruding portions 164 may be adjacent to burner 110 and spaced apart from burner 110, and then may be in contact with burner 110, when an external force is applied to burner 110 or the second plate 161 is deformed (e.g., heat deformation). Accordingly, burner 110 may be prevented from being directly in contact with second plate 161 by the one or more protruding portions 164. Also, because second plate 161 includes the one or more protruding portions 164, thermal deformation of the second plate 161 may be minimized.

When burner 110 is installed at second cover 160, and first cover 140 is attached to second cover 160, burner 110 is spaced apart from first plate 141 of first cover 140 and second plate 161. Accordingly, the air outside frame 21 that is supplied into the combustion chamber C may flow between first plate 141 and burner 110 and between second plate 161 and burner 110.

When second plate 161 includes a plurality of protruding portions 164, plurality of protruding portions 164 may be overlapped with burner 110 in a forward and backward direction when burner 110 is installed at second cover 160. The second plate 161 may further include one or more stabilizer fastening holes 163 to which the stabilizer 180 is attached.

The second fastening part 166 may include one or more second fastening holes 169 to which the fastening member passed through first fastening hole 150 of first fastening part 149 is attached.

According to another embodiment of the invention, first cover 140 and second cover 160 may not include first fastening part 149 and second fastening part 166, but first extension part 148 of first cover 140 and second extension part 165 of second cover 160 may be attached to each other by the fastening member.

The second cover 160 may further include a second insertion part 167 which passes through bottom wall 32 of frame 21. One or more second introduction holes 167*a* may be provided at second insertion part 167. Therefore, the one or more second introduction holes 167*a* may be located outside frame 21. Accordingly, air outside of the frame 21 may be supplied to the combustion chamber C through the one or more second introduction holes 167*a*.

When first cover 140 is attached to the second cover 160, at least a part of first insertion part 151 of first cover 140 may be spaced apart from second insertion part 167 of second cover 160.

FIG. 8 illustrates an example in which a plurality of second introduction holes 167*a* are arranged to be horizontally spaced apart from each other. It is understood that the invention is not limited to any particular number, arrangement, and/or shape of the second introduction holes 167*a*.

According to the embodiment, the air outside frame 21 may be smoothly introduced into the combustion chamber C by the one or more first introduction holes 143 provided at first cover 140 and one or more second introduction holes 167*a* provided at second cover 160.

The second cover 160 may further include one or more installation parts 168 for installing second cover 160 at rear wall 35 of frame 21. It is understood that the invention is not limited to the one or more installation parts 168 being provided at the second plate 161.

Therefore, when second cover 160 is installed or provided at rear wall 35 of frame 21 by installation parts 168, second plate 161 may be spaced apart from rear wall 35 of frame 21. The fan 210 may be disposed in a space between second plate 161 and rear wall 35 of frame 21. That is, the fan 210 is disposed at a separate space outside the combustion chamber C that is formed by burner cover 130.

The second cover 160 may further include a burner through-portion 171 through which a part of burner 110 passes. The burner through-portion 171 may protrude from second plate 161 to a rear side thereof, but is not limited to such configuration. For example, second plate 161 may be formed so that burner through-portion 171 protrudes from second plate 161 toward the rear side thereof.

A burner through-hole 172 may be provided at burner through-portion 171. The burner through-hole 172 may be aligned with burner hole 36 formed at rear wall 35 of frame 21. When second cover 160 is installed or provided at rear wall 35 of frame 21, burner through-portion 171 may be in contact with rear wall 35 of frame 21.

The heated air passed through second opening 162 of burner cover 130 flows through a space between burner cover 130 and rear wall 35 of frame 21, and then is discharged to cooking chamber 22 through air discharge port 194 of assembly cover 190. At this time, when second cover 160 is installed or provided at rear wall 35 of frame 21, burner through-portion 171 is in contact with rear wall 35 of frame 21, and thus the heated air may be prevented from being introduced again into the combustion chamber C through burner through-hole 172. Also, the heated air may be prevented from being discharged to a location outside of frame 21 through burner hole 36 formed at rear wall 35 of frame 21.

Figure 10:
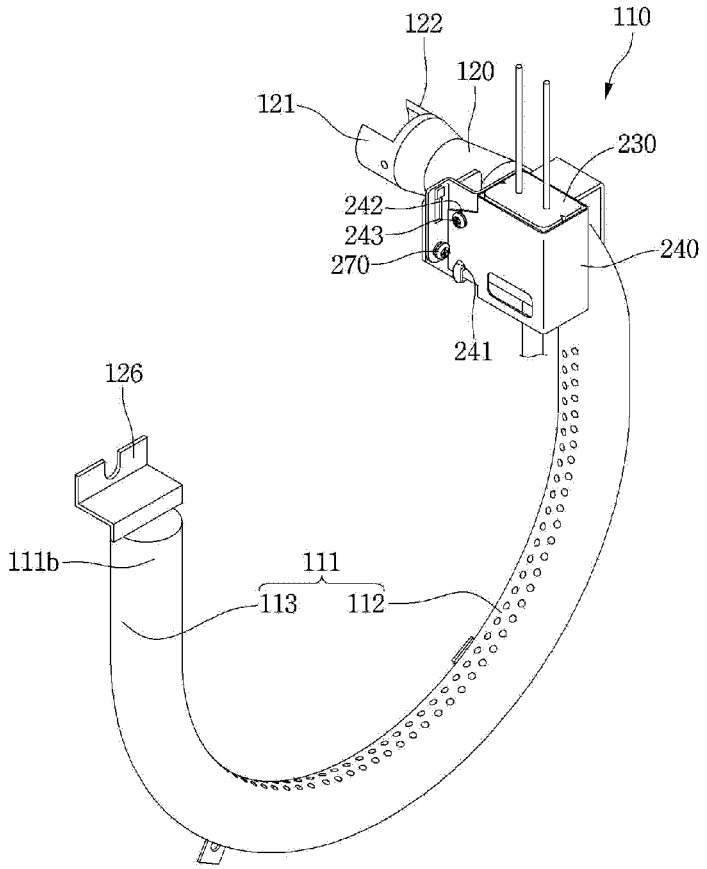
FIG. 10 is a view illustrating a state in which an ignition unit installed at a burner according to an embodiment of the present disclosure.
Figure 11:
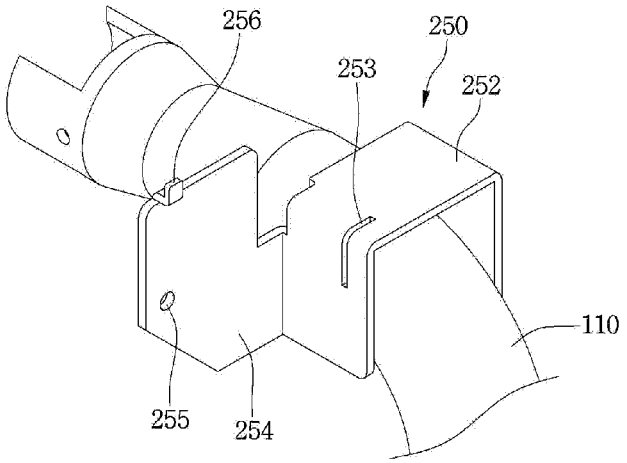
FIG. 11 is a view illustrating a state in which the ignition unit is separated from the burner according to an embodiment of the present disclosure.
Figure 12:
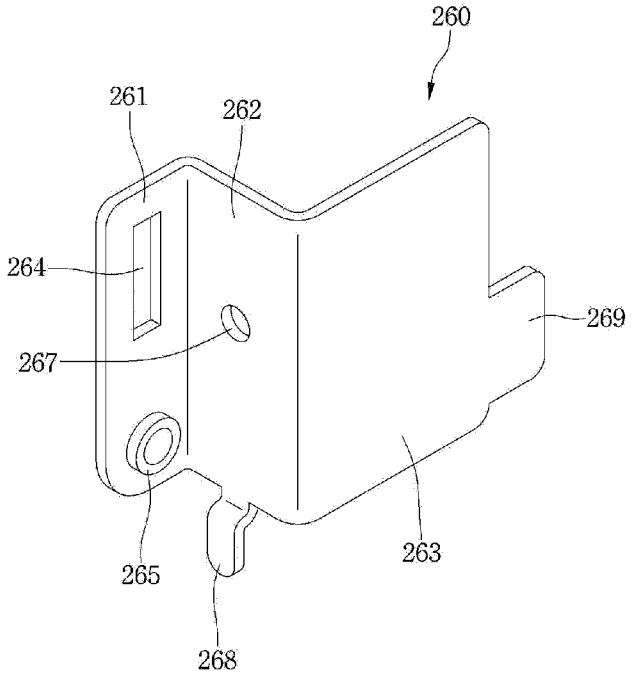
FIG. 12 is a perspective view of a second bracket which is coupled to the ignition unit.

FIG. 10 is a view illustrating a state in which the ignition unit is installed or provided at the burner according to an embodiment of the invention. FIG. 11 is a view illustrating a state in which the ignition unit is separated from the burner. FIG. 12 is a perspective view of a second bracket which is coupled to the ignition unit.

Referring to FIGS. 10, 11, and 12, burner 110 may include a burner tube 111 of which both ends are spaced apart from each other. In such embodiment, burner tube 111 may be formed in a non-annular shape. For example, at least a part of burner tube 111 may be formed in a "U" shape, but is not limited thereto.

A supply part 120 through which the gas and the air are supplied is provided at a first end 111*a* of burner tube 111, and a second end 111*b* of burner tube 111 is blocked. The supply part 120 may extend in an inclined manner from first end 111*a* of the burner tube 111. Therefore, a flow direction of the gas and the air supplied through supply part 120 may be changed at first end 111*a*, and then the gas and the air may flow toward second end 111*b* along burner tube 111. Accordingly, the gas and the air supplied through supply part 120 may flow in burner tube 111 in a single direction.

The burner tube 111 may be formed in an overall curved shape, such that the entire burner tube 111 has a curved shape. Alternatively, one or more of first end 111*a* and second end 111*b* of the burner tube 111 may be formed in a linear shape, and the other portions thereof may be formed in the curved shape.

The burner tube 111 may include an inner circumferential surface 112 and an outer circumferential surface 113. A plurality of gas outlet holes 114 and 115 may be provided at inner circumferential surface 112 of burner tube 111. The plurality of gas outlet holes 114 and 115 may be arranged in a plurality of rows. Each "row" includes a set of gas outlet holes that are arranged in the same direction as an extending direction of burner tube 111. The plurality of rows of gas outlet holes 114 and 115 may include a plurality of first gas outlet holes 114 and a plurality of second gas outlet holes 115.

FIG. 10 illustrates an example in which gas outlet holes 114 and 115 are provided at inner circumferential surface 112 of burner tube 111 in two rows. It is understood that the number of rows of the gas outlet holes is not so limited. That is, gas outlet holes 114 and 115 may be provided at inner circumferential surface 112 of burner tube 111 in a single row.

The gas outlet holes 114 and 115 in one of the rows may be disposed or arranged to be spaced apart from each other in a lengthwise direction of burner tube 111. The gas outlet holes 114 in one of the rows may be spaced apart from gas outlet holes 115 in the other row.

The gas outlet holes 114 and 115 in the adjacent two rows may be arranged in a zigzag method so that interference of the flame occurring at gas outlet holes 114 and 115 in the two rows is prevented; however, it is understood that the invention is not limited to such arrangement. That is, the gas outlet holes 115 in the other row may be disposed at areas corresponding to areas among adjacent gas outlet holes 114 in a single row.

When an amount of the mixed gas discharged from the gas outlet holes 114 and 115 is increased, the resulting flame becomes larger. Since second end 111*b* of burner tube 111 is blocked, the mixed gas is accumulates toward second end 111*b*. Therefore, when a diameter of each of the gas outlet holes at a side of first end 111*a* is the same as that of each of the gas outlet holes at a side of second end 111*b*, the flame of the gas outlet holes at the side of second end 111*b* becomes larger, because the amount of the large amount of mixed gas at the side of second end 111*b*.

However, in the case of the embodiment, the diameter of each of the gas outlet holes at the side of second end 111*b* may be formed smaller than that of each of the gas outlet holes at the side of first end 111*a* so that an overall size of the flame at gas outlet holes 114 and 115 of the burner tube 111 becomes uniform.

Alternatively, based on a line which equally divides a length of burner tube 111, a diameter of each of the gas outlet holes at a portion including second end 111*b* may be formed smaller than that of each of the gas outlet holes of burner tube 111 including first end 111*a*.

A radius of inner circumferential surface 112 of burner tube 111 may be larger than that of second opening 162 of second cover 160. When second opening 162 is formed in the non-annular shape, the radius of inner circumferential surface 112 of burner tube 111 may be larger than a maximum length of second opening 162.

One or more installation parts 126 for installing burner tube 111 at second cover 160 may be provided at burner tube 111. For example, installation parts 126 may be attached to the second cover 160 by screws or similar fastening structures. It is understood that the invention is not limited to any specific coupling method between installation parts 126 and second cover 160.

When installation parts 126 are attached to second cover 160, burner tube 111 may be spaced apart from second plate 161 of second cover 160.

The supply part 120 may include a plurality of guides 121 and 122 for alignment with nozzle holder 220. The plurality of guides 121 and 122 are spaced apart from each other, and air outside the frame 21 may be introduced into supply part 120 together with the gas injected from nozzle holder 220 through a space between the plurality of guides 121 and 122. The supply part 120 may pass through burner through-hole 172 of second cover 160 and burner hole 36 formed at rear wall 35 of frame 21. Accordingly, since the plurality of gas outlet holes are formed at the inner circumferential surface of burner 110, and the air passes through an area formed by the plurality of gas outlet holes, the air in cooking chamber 22 may be sufficiently heated by heat of the flame of burner 110.

Also, because the flame is generated at the inner circumferential surface of burner 110, a distance between the flames is reduced, as it becomes distant from the gas outlet holes, and thus a phenomenon in which the flame is extinguished due to the flow of the air may be prevented.

A relative position of ignition unit 230 with respect to burner 110 may be fixed by a fixing device. For example, ignition unit 230 may be installed at burner 110 by the fixing device. The fixing device may include a first bracket 250 attached to burner 110, and a second bracket 260 attached to ignition unit 230. The second bracket 260 may be separably connected to first bracket 250. Alternatively, second bracket 260 may be directly connected to first bracket 250, or may be connected to first bracket 250 by a separate connection member.

Hereinafter, embodiments in which the second bracket 260 is directly and separably connected to first bracket 250 will be described.

For example, first bracket 250 may be attached to a position of burner 110 that is close to supply part 120. The first bracket 250 may include a burner coupling part 252 that is attached to the burner 110. For example, burner coupling part 252 may be welded to an outside portion of the burner 110, or may be attached to a fastening part (not shown) provided at an outside of the burner 110 by, for example, a screw.

The first bracket 250 may further include a bracket coupling part 254 to attach with second bracket 260. The bracket coupling part 254 may be integrally formed with the burner coupling part 252, or may be attached to the burner coupling part 252.

When first bracket 250 is attached to burner 110, first bracket 250 may be located between first end 111*a* and second end 111*b* of burner tube 111. The bracket coupling part 254 may include a first hook 256 for attaching with the second bracket 260. The bracket coupling part 254 may further include a first fastening hole 255 for attaching with second bracket 260 by a first fastening member 270.

The first hook 256 and first fastening hole 255 may be vertically spaced apart from each other; however, it is understood that the invention is not limited to such arrangement. For example, the first hook 256 may be located above or below first fastening hole 255.

The second bracket 260 may include a first fastening part 261 for attaching with first bracket 250.

The first fastening part 261 may include a hook coupling hole 264 to which first hook 256 is attached.

As another example, first hook 256 may be provided at second bracket 260, and hook coupling hole 264 may be provided at first bracket 250.

The first fastening part 261 may further include a second fastening hole 265 for attaching with first bracket 250 by first fastening member 270. When first hook 256 of first bracket 250 is attached to hook coupling hole 264, first fastening member 270 may be attached to second fastening hole 265 and first fastening hole 255.

The hook coupling hole 264 and second fastening hole 265 may be vertically spaced apart from each other; however, it is understood that the invention is not limited to such arrangement. For example, hook coupling hole 264 may be provided above or below second fastening hole 265.

The second bracket 260 may further include a second fastening part 262 for attaching with ignition unit 230. The second fastening part 262 may be bent from first fastening part 261.

The second fastening part 262 may include a second hook 268 for coupling with the ignition unit 230.

The second fastening part 262 may further include a third fastening hole 267 through which a second fastening member 243 to be attached to the ignition unit 230 passes.

The second hook 268 and the third fastening hole 267 may be vertically spaced apart from each other; however, it is understood that the invention is not limited to such arrangement. For example, the third fastening hole 267 may be located above or below the second hook 268.

To prevent interference between first fastening member 270 attached to second fastening hole 265 and second fastening member 243 attached to third fastening hole 267, second fastening hole 265 and third fastening hole 267 may be disposed at different heights of second bracket 260. FIG. 12 illustrates an example in which third fastening hole 267 is located above than second fastening hole 265. However, second fastening hole 265 may be located above than third fastening hole 267. That is, first fastening member 270 and second fastening member 243 may have different coupling heights from each other.

In the embodiment, a fastening or attaching direction of first fastening member 270 is not limited, but may be a forward and backward direction of cooking chamber 22.

Alternatively, the fastening or attaching direction of first fastening member 270 may be in parallel with a flowing direction of the air passing through first and second openings 142 and 162 of burner cover 130.

The second bracket 260 may further include a third fastening part 263 which is attached to burner coupling part 252 of first bracket 250. The third fastening part 263 may be bent from second fastening part 262. The third fastening part 263 may be arranged in parallel with first fastening part 261, but is not limited thereto.

The third fastening part 263 may include a coupling rib 269 which is coupled to burner coupling part 252. For example, coupling rib 269 may be inserted into burner coupling part 252. The burner coupling part 252 may include a rib insertion hole 253 in which coupling rib 269 is inserted.

The ignition unit 230 may include a fastening guide 240. The fastening guide 240 may include a hook through-hole 241 through which second hook 268 passes. The fastening guide 240 may include a fourth fastening hole 242 to which second fastening member 243 is attached.

When second hook 268 passes through hook through-hole 241, second fastening member 243 may be attached to fourth fastening hole 242 and third fastening hole 267.

As another example, fastening guide 240 may include second hook, and second bracket 260 may include the hook through-hole through which the second hook passes.

Figure 13:
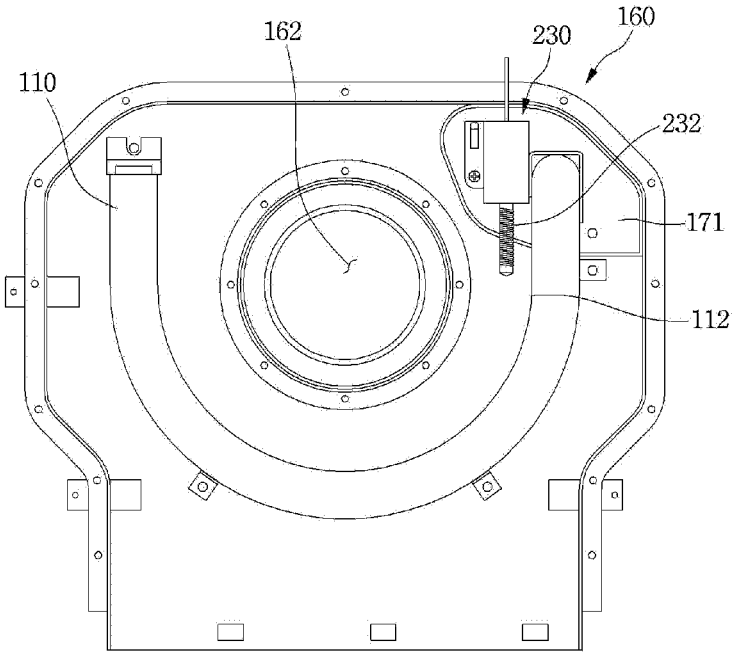
FIG. 13 is a view illustrating a state in which the burner having the ignition unit is installed at the burner cover.

FIG. 13 is a view illustrating a state in which the burner having the ignition unit is installed or provided at the burner cover.

Referring to FIGS. 11, 12, and 13, a part of ignition unit 230 may be located or provided at burner through-portion 171 of burner cover 130. Alternatively, at least a portion of the fixing device may be located within an area formed by burner through-portion 171 of burner cover 130. Alternatively, first fastening member 270 attached to first bracket 250 and second bracket 260 may be attached to burner through-portion 171. Alternatively, first fastening member 270 may be attached to first bracket 250 and second bracket 260 may be attached to burner through-portion 171 and rear wall 35 of frame 21. Accordingly, since at least a portion of the fixing device is located within the area formed by burner through-portion 171, a width of burner cover 130 in a forward and backward direction thereof may be reduced or limited.

The ignition unit 230 may include an ignition bar 232. The ignition bar 232 may extend in a vertical direction. The ignition bar 232 is a part which is heated to a high temperature, and the mixed gas may be ignited by being in contact with ignition bar 232.

When ignition unit 230 is installed or provided at burner 110 by the fixing device, ignition bar 232 may be spaced apart from inner circumferential surface 112 of burner 110. The ignition bar 232 may be located at an area between inner circumferential surface 112 of burner 110 and second opening 162.

The ignition bar 232 may face one or more gas outlet holes 114 and 115 provided at inner circumferential surface 112 of burner 110. That is, the mixed gas discharged from burner 110 through one or more gas outlet holes 114 and 115 may flow to ignition bar 232, and thus the mixed gas may be ignited.

Hereinafter, a method for assembling the burner assembly and a method for separating the ignition unit according to embodiments of the invention are described.

The nozzle holder 220 and fan motor 212 may be installed or provided at rear wall 35 of frame 21 from an outside of frame 21. When fan 210 is located or provided at a front of rear wall 35 of frame 21, fan motor 212 may be attached to fan 210.

Also, second cover 160 may be attached to rear wall 35 of frame 21 from an inside of frame 21. In such arrangement, burner 110 is installed or provided at second cover 160, and ignition unit 230 is installed at burner 110. Specifically, second bracket 260 to which ignition unit 230 is attached may be attached to first bracket 250 which is attached to burner 110. First, when first hook 256 of first bracket 250 passes through hook coupling hole 264 of second bracket 260, first fastening member 270 may be attached to second fastening hole 265 and first fastening hole 255. At this time, first fastening member 270 may be attached to each of the first and second fastening holes 255 and 265 in a forward and backward direction of cooking chamber 22.

In such arrangement, first cover 140 is attached to second cover 160. Assembling of burner assembly 23 is completed when assembly cover 190 is coupled to rear wall 35 of frame 21 from an inside of the frame 21. To separate ignition unit 230 from cooking device 1, door 25 may be opened. The assembly cover 190 may then be separated from rear wall 35 of frame 21, and first cover 140 may then be separated from second cover 160.

The first fastening member 270 may then be released from an attached state. At this time, the attached state of first fastening member 270 may be released in the forward and backward direction of cooking chamber 22. When the attached state of first fastening member 270 is released, first hook 256 is separated from hook coupling hole 264 of second bracket 260. Second bracket 260 to which ignition unit 230 is coupled may then be separated from first bracket 250, and ignition unit 230 may then be removed from the cooking device 1. If necessary, the coupling between the ignition unit 230 and the second bracket 260 may be released.

Accordingly, because a position of ignition unit 230 with respect to the burner located inside the frame 21 may be fixed by the fixing device, the ignition unit 230 can be more easily removed from cooking device 1 when it is necessary to replace or check the ignition unit.

Also, when the first bracket coupled to the burner and the second bracket coupled to the ignition unit are coupled to each other by the hook, the first bracket and the second bracket can be coupled using the fastening member, and thus the number of fastening members can be reduced, and also an operation time can be reduced. Also, because an attaching or releasing direction of the first fastening member is in the forward and backward directions of the cooking chamber, the user can more easily couple or release the first fastening member.

Also, when the fastening rib of the third fastening part is inserted into the burner coupling part, the first fastening part can be attached to the bracket coupling part by the first fastening member. Accordingly, when the first fastening member is attached, the bracket fastening part can be prevented from being deformed with respect to the burner coupling part.

Figure 14:
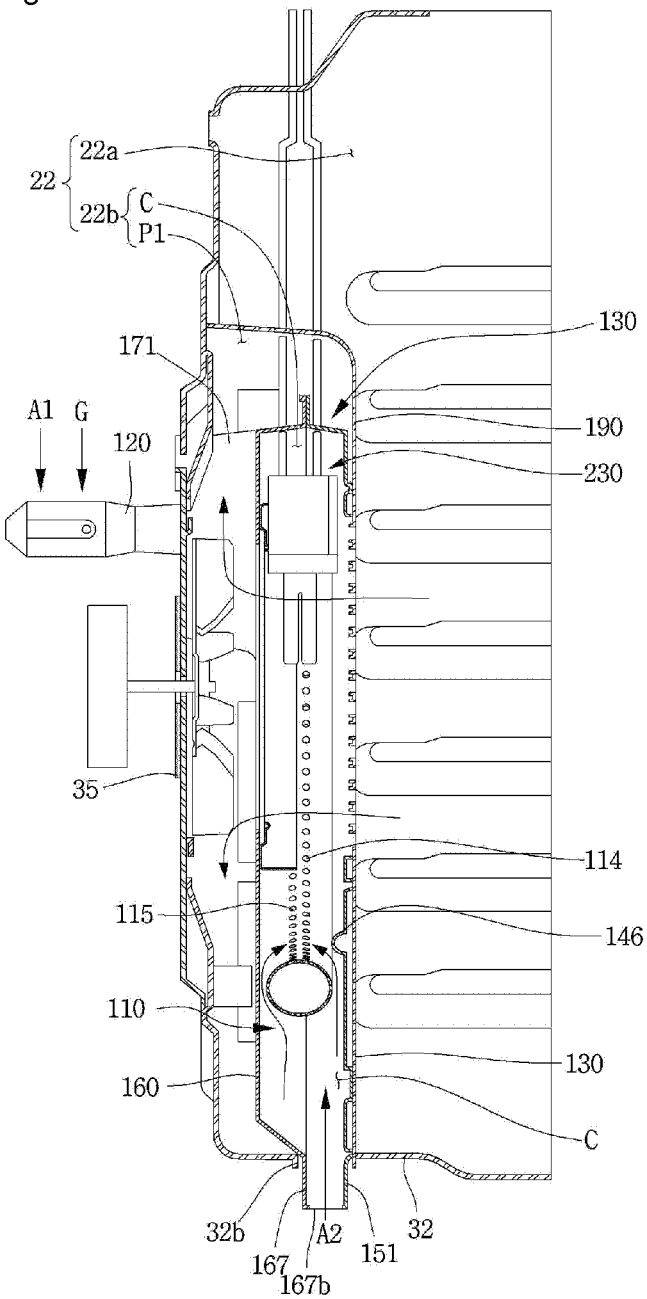
FIG. 14 is a vertical cross-sectional view illustrating a state in which the burner assembly is installed at a frame according to an embodiment of the invention.

FIG. 14 is a vertical cross-sectional view illustrating a state in which the burner assembly is installed or provided at the frame according to an embodiment of the present disclosure.

Referring to FIG. 14, a through-hole 32*b* through which the first and second insertion parts 151 and 167 of burner cover 130 pass may be formed at bottom wall 32 of frame 21. Therefore, as the first and second insertion parts 151 and 167 of burner cover 130 pass through through-hole 32*b*, the first and second insertion parts 151 and 167 may be located outside of frame 21.

At least a portion of first insertion part 151 may be spaced apart from second insertion part 167, and may form a third introduction hole 167*b*. The fan 210 is provided at an exhaust path P1, which is an external space of the combustion chamber C. The exhaust path P1 may be formed by an outer surface of burner cover 130, rear wall 35 of the frame 21, and assembly cover 190.

Therefore, according to an embodiment of the invention, when the plurality of gas outlet holes 114 and 115 are formed at the inner circumferential surface of burner 110, and fan 210 is provided at the exhaust path P1 which is independent from the combustion chamber C, the fan 210 may be prevented from being heated by the flame of the burner 110. Also, because the air is heated by being in contact with the flame of burner 110 and then flows toward fan 210, the air may be sufficiently heated by the heat of the flame.

Moreover, because the air is heated in the combustion chamber C by the flame generated from the inner circumferential surface of burner 110, and then flows toward fan 210, the air may be heated by the flame even when the flame is bent toward the fan 210 by the flow of the air due to rotation or operation of fan 210.

Hereinafter, an operation of the burner assembly will be described according to an embodiment of the invention.

When the operation of the burner assembly 23 is started, the gas is injected from nozzle holder 220 to supply part 120 of burner 110. Then, air A1 (the air outside the frame) around supply part 120 is supplied to supply part 120 together with the gas. At this time, since a low pressure is formed around the gas supplied to supply part 120, the air A1 around supply part 120 is naturally supplied to supply part 120 due to a pressure difference (in a natural ventilation method).

Accordingly, when the air is supplied to supply part 120 in the natural ventilation method, the air necessary to burn the gas may not be sufficiently supplied to supply part 120. In this case, the mixed gas in which the gas and the air are mixed may be incompletely burned in burner 110, and thus an amount of carbon monoxide may be increased due to the incomplete combustion.

However, according to embodiments of the disclosure, because the first and second insertion parts 151 and 167 of burner cover 130 pass through bottom wall 32 of frame 21, and are located outside of frame 21, additional air A2 for burning the mixed gas of burner 110 may be introduced into the combustion chamber C.

Also, because the plurality of introduction holes 143, 167*a* and 167*b* provided at burner cover 130 are located outside of frame 21, the additional air A2 for burning the mixed gas of burner 110 may be introduced into the combustion chamber C.

The additional air A2 introduced into the combustion chamber C may flow toward burner 110. As described above, because burner 110 is spaced apart from first plate 141 of first cover 140 and second plate 161 of second cover 160, the air in the combustion chamber C may flow through a space provided between burner 110 and first plate 141 and a space provided between burner 110 and second plate 161.

Therefore, the air introduced into the combustion chamber C may smoothly flow toward first gas outlet holes 114 and second gas outlet holes 115 formed at burner 110. Accordingly, because the air guide 146 is formed at first cover 140, the additional air A2 may be guided toward first gas outlet holes 114 by air guide 146, and thus the additional air A2 may be sufficiently supplied to first gas outlet holes 114.

Meanwhile, while the mixed gas is supplied to burner 110, the mixed gas is ignited by ignition unit 230, and the flame is generated from burner 110. When the fan 210 is turned on and rotated, the air in cooking chamber 22 is introduced into the combustion chamber C through air suction port 192 of assembly cover 190. The air introduced into the combustion chamber C passes through an area formed by inner circumferential surface 112 of burner 110. The air introduced into the combustion chamber C is heated by the flame generated from burner 110, and then discharged from the combustion chamber C. The air discharged from the combustion chamber C flows through the exhaust path P1 provided between second cover 160 and rear wall 35 of frame 21, and then is discharged into cooking chamber 22 through air discharge port 194 of assembly cover 190. Accordingly, burner cover 130 separately forms the combustion chamber C, and the combustion chamber C and exhaust path P1 are partitioned by burner cover 130. Therefore, air flowing through the exhaust path P1 may be prevented from being introduced again into the combustion chamber C.

It is understood that while first bracket 250 is coupled to burner 110 in the above-described embodiment, first bracket 250 may alternatively be provided at burner cover 130. For example, first bracket 250 may be attached to second cover 160, and second bracket 260 may be attached to first bracket 250. In this case, the position of ignition unit 230 with respect to burner 110 may be fixed by coupling second bracket 260 to first bracket 250.

Figure 15:
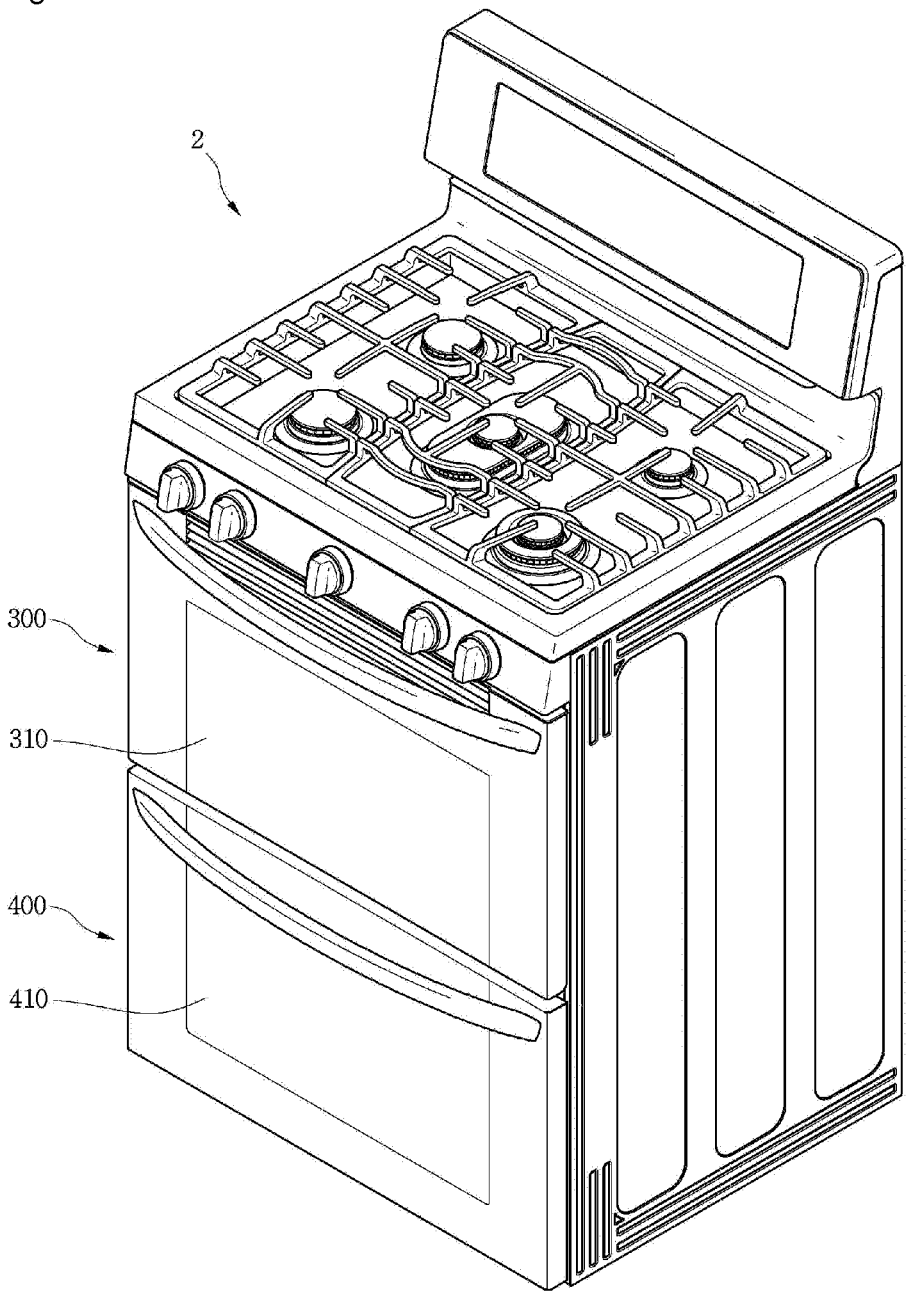
FIG. 15 is a perspective view of a cooking device according to another embodiment of the present disclosure.
Figure 16:
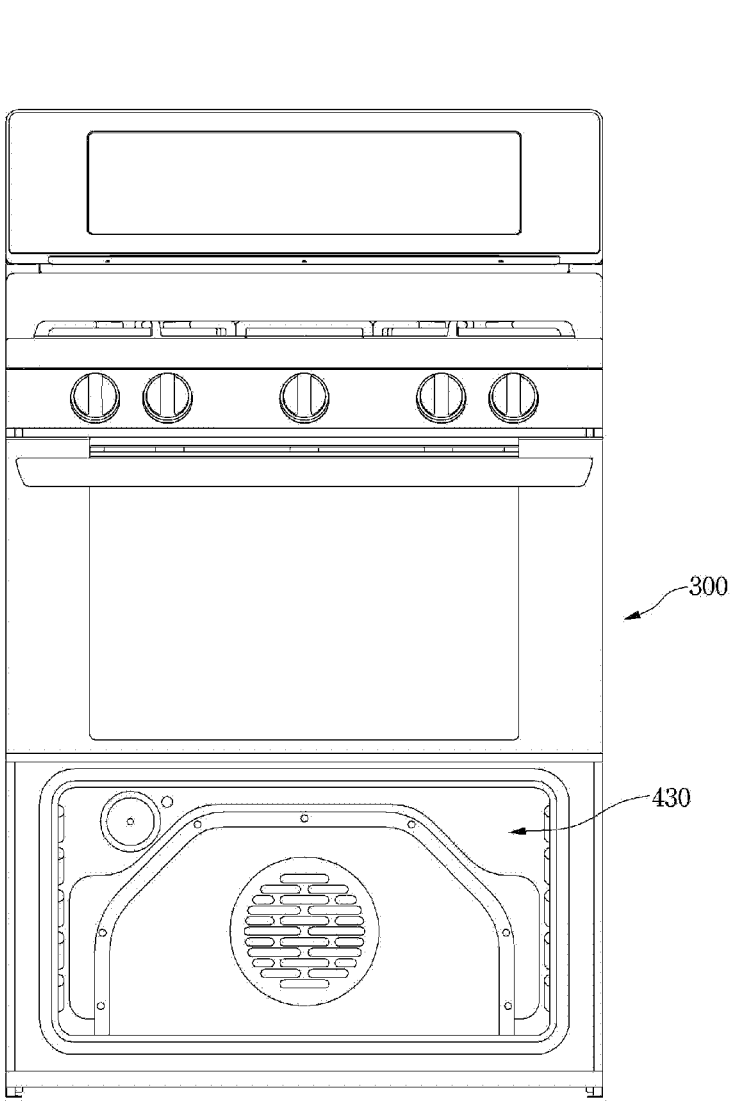
FIG. 16 is a front view of the cooking device of FIG. 15 in which a second door is separated.

FIG. 15 is a perspective view of a cooking device according to another embodiment of the present disclosure, and FIG. 16 is a front view of the cooking device of FIG. 15 in which a second door is separated. The embodiment is the same as the previous embodiment, except for the number of oven units.

Referring to FIGS. 15 and 16, a cooking device 2 according to the embodiment may include a plurality of oven units 300 and 400. The plurality of oven units 300 and 400 may include a first oven unit 300, and a second oven unit 400 located below first oven unit 300. The plurality of oven units 300 and 400 may include doors 310 and 410, respectively.

A burner assembly 430 is provided at one or more of the plurality of oven units 300 and 400. A structure of the burner assembly 430 is the same as that of the burner assembly described above, and thus a description thereof will be omitted.

FIG. 16 illustrates an embodiment in which burner assembly 430 is provided at second oven unit 400. However, it is understood that burner assembly 430 may alternatively be provided at the first oven unit 300, or at each of the plurality of oven units 300 and 400.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking device comprising:

a frame that forms a cooking chamber;

a burner provided in the frame and having a plurality of gas outlet holes;

an ignition unit provided in the frame to ignite a mixed gas discharged from at least one of the plurality of gas outlet holes;

a fixing device to affix a position of the ignition unit with respect to the burner; and a burner cover to which the ignition unit is fixed, wherein the burner cover comprises a burner through-portion through which the burner passes and is in contact with the frame, and a portion of the ignition unit is provided within an area formed by the burner through-portion.

2. The cooking device of claim 1, wherein the fixing device affixes the ignition unit to the burner.

3. The cooking device of claim 2, wherein the fixing device comprises a first bracket that is attached to the burner, and a second bracket that is attached to the ignition unit.

4. The cooking device of claim 2, wherein the second bracket is separably attachable to the first bracket.

5. The cooking device of claim 4, wherein one of the first bracket and the second bracket comprises a first hook, and the other one thereof comprises a hook coupling hole to which the first hook is attached, and when the first hook is attached to the hook coupling hole, the first and second brackets are fastened together by a first fastening member.

6. The cooking device of claim 5, wherein the first fastening member fastens the first bracket and the second bracket in a forward and backward direction with respect to the cooking chamber.

7. The cooking device of claim 5, wherein one of the second bracket and the ignition unit comprises a second hook, and the other one thereof comprises a hook through-hole in which the second hook passes, and when the second hook passes in the hook through-hole, the second bracket and the ignition unit are fastened together by a second fastening member.

8. The cooking device of claim 7, wherein the first fastening member is positioned at a different height than the second fastening member.

9. The cooking device of claim 5, wherein the second bracket further comprises a fastening rib, and the first bracket further comprises a rib insertion hole in which the fastening rib is inserted.

10. The cooking device according to claim 9, wherein, when the fastening rib is inserted in the rib insertion hole, the first bracket and the second bracket are fastened together by the first fastening member.

11. The cooking device of claim 1, wherein the ignition unit comprises an ignition bar that faces at least one of the plurality of gas outlet holes of the burner.

12. The cooking device of claim 11, wherein the burner comprises a burner tube of which opposite ends of the burner tube are spaced apart from each other, and the burner tube comprises an inner circumferential surface and an outer circumferential surface, and the plurality of gas outlet holes are provided at the inner circumferential surface.

13. The cooking device of claim 11, wherein the burner cover comprises an opening through which air passes, and the ignition bar is provided at an area between the opening of the burner cover and the burner tube.

14. A cooking device comprising:

a frame that forms a cooking chamber;

a burner cover provided in the frame to form a combustion chamber that is partitioned from the cooking chamber;

a burner provided at the combustion chamber and having a plurality of gas outlet holes;

an ignition unit provided at the combustion chamber to ignite a mixed gas discharged from at least one of the plurality of gas outlet holes; and a fixing device to support the ignition unit;

wherein the burner cover comprises a burner through-portion through which the burner passes and is in contact with the frame, and a portion of the ignition unit is provided within an area formed by the burner through-portion.

15. The cooking device of claim 14, wherein the fixing device comprises a first bracket that is attached to the burner or the burner cover, and a second bracket that is attached to the ignition unit, wherein the second bracket is separably attachable to the first bracket.

16. The cooking device of claim 14, wherein one of the first bracket and the second bracket comprises a hook, and the other one thereof comprises a hook coupling hole to which the hook is attached, and when the hook is attached to the hook coupling hole, the first bracket and second brackets are fastened together by a fastening member.

17. The cooking device of claim 14, wherein the burner cover comprises an opening through which air passes, and the fastening member fastens the first and second brackets together in a direction which is parallel with a flowing direction of air passing through the opening.

* * * * *